US005516301A

United States Patent [19]

Kawakita

[11] Patent Number: 5,516,301

[45] Date of Patent: May 14, 1996

[54] DRAINAGE CONSTRUCTION FOR ELECTRICAL CONNECTION BOX

[75] Inventor: Shinji Kawakita, Yokkaichi, Japan

[73] Assignee: Sumitimo Wiring Systems, Ltd., Yokkaichi, Japan

[21] Appl. No.: 269,683

[22] Filed: Jul. 1, 1994

[30] Foreign Application Priority Data

Aug. 18, 1993 [JP] Japan ..... 5-044944 U

[51] Int. Cl.[6] ..... H01R 4/60

[52] U.S. Cl. ..... 439/206; 439/733.1

[58] Field of Search ..... 439/206, 733, 439/746, 751, 869, 747, 748

[56] References Cited

U.S. PATENT DOCUMENTS

| | | | |
|---|---|---|---|
| 3,122,407 | 2/1964 | Lowe | 439/733 |
| 3,865,462 | 2/1975 | Cobaugh et al. | 439/741 |
| 4,035,047 | 7/1977 | Ammon | 439/733 |
| 4,534,609 | 8/1985 | White | 439/749 |
| 4,575,176 | 3/1986 | Castello et al. | 439/751 |
| 4,697,864 | 10/1987 | Hayes et al. | 439/444 |
| 4,744,771 | 5/1988 | Uchida | 439/733 |
| 4,750,889 | 6/1988 | Ignasiak et al. | 439/83 |
| 4,871,884 | 10/1989 | Hayashi | 174/52.1 |
| 4,963,099 | 10/1990 | Sato et al. | 439/206 |
| 5,147,228 | 9/1992 | Miller et al. | 439/741 |

FOREIGN PATENT DOCUMENTS

| | | |
|---|---|---|
| 0309860 | 4/1989 | European Pat. Off. . |
| 1156236 | 6/1969 | United Kingdom . |
| 2191642 | 12/1987 | United Kingdom . |
| 2273828 | 6/1994 | United Kingdom . |

*Primary Examiner*—Neil Abrams
*Assistant Examiner*—Hien D. Vu
*Attorney, Agent, or Firm*—Greenblum & Bernstein

[57] ABSTRACT

In a drainage construction for an electrical connection box in which bus bars are accommodated and tabs projecting from the bus bars are, respectively, projected from terminal through-holes of a lower casing of the electrical connection box so as to be connected to a wiring harness, the improvement comprising: the terminal through-holes each including a main section and a drainage section; the main section having a shape substantially identical with a cross-sectional shape of each of the tabs; and the drainage section abutting on the main section so as to increase a width of each of the terminal through-holes.

5 Claims, 3 Drawing Sheets

DRAINAGE CONSTRUCTION FOR ELECTRICAL CONNECTION BOX

BACKGROUND OF THE INVENTION

The present invention generally relates to an electrical connection box for connecting, through branching, wiring harnesses installed in a motor vehicle and more particularly, to a drainage construction for the electrical connection box, which is capable of easily and positively discharging water penetrating into the electrical connection box.

Usually, an electrical connection box such as a junction block, a relay block, etc. is formed by assembling a lower casing and an upper casing. In the electrical connection box, bus bars for branch connection are accommodated through insulation plates and tabs bent from the bus bars are projected from terminal through-holes formed on the lower casing or the upper casing so as to be connected to wiring harnesses.

Namely, as shown in FIGS. 1 and 2, a plurality of tabs 2 projecting from bus bars (not shown) are inserted from above through a plurality of terminal through-holes 1*b* formed on a bottom plate 1*a* of a lower casing 1 so as to be connected to connectors (not shown) provided at a distal end of a wiring harness. At this time, each of the terminal through-holes 1*b* is formed into a shape substantially identical with that of each of the tabs 2 as shown in FIG. 1 and the tab 2 is passed through the terminal through-hole 1*b* through its substantial contact with the terminal through-hole 1*b* so as to be closely held by the terminal through-hole 1*b* as shown in FIG. 2. Meanwhile, although not specifically shown, an upper cover is mounted on an upper portion of the upper casing, while a lower cover is mounted on a lower portion of the lower casing 1. The connectors to be connected to the bus bars are accommodated in the lower cover and the lower cover is formed with a drainage hole.

Such a phenomenon that water penetrates into the electrical connection box formed by the upper and lower casings may be caused by dropwise condensation or the like. In such a case, water drops reach the bottom plate 1*a* of the lower casing 1 via the tabs 2 as shown in FIG. 3. However, since there is substantially no gap between the tab 2 and the terminal through-hole 1*b*, water drops proceeding along the tabs 2 are spread on an upper face of the bottom plate 1*a* so as to bridge neighboring tabs 2 for electrical conduction therebetween as shown in FIG. 3. As a result, such a problem may arise that shortcircuiting occurs in the circuit, thereby resulting in malfunction of the circuit.

SUMMARY OF THE INVENTION

Accordingly, an essential object of the present invention is to provide a drainage construction for an electrical connection box, which is capable of positively discharging water penetrating into the electrical connection box due to dropwise condensation or the like.

In order to accomplish this object of the present invention, there is provided a drainage construction for an electrical connection box in which bus bars are accommodated and tabs projecting from the bus bars are, respectively, projected from terminal through-holes of a lower casing of the electrical connection box so as to be connected to a wiring harness, according to the present invention, the improvement comprising: the terminal through-holes each including a main section and a drainage section; the main section having a shape substantially identical with a cross-sectional shape of each of the tabs; and the drainage section abutting on the main section so as to increase a width of each of the terminal through-holes.

For example, the drainage section intersects with the main section substantially orthogonally at a longitudinally central portion of the main section such that each of the terminal through-holes has a substantially crossed shape.

In the present invention, since the drainage section is formed so as to increase the width of each of the terminal through-holes, water drops penetrating into the electrical connection box and proceeding to the lower casing along the tabs are discharged outwardly through the drainage sections. Therefore, such an undesirable phenomenon associated with a prior art electrical connection box can be prevented that water spreads between the tabs on an upper face of the lower casing so as to cause shortcircuiting.

BRIEF DESCRIPTION OF THE DRAWINGS

This object and features of the present invention will become apparent from the following description taken in conjunction with the preferred embodiment thereof with reference to the accompanying drawings, in which.

Before the description of the present invention proceeds, it is to be noted that like parts are designated by like reference numerals throughout several views of the accompanying drawings.

DETAILED DESCRIPTION OF THE INVENTION

Figure 1:
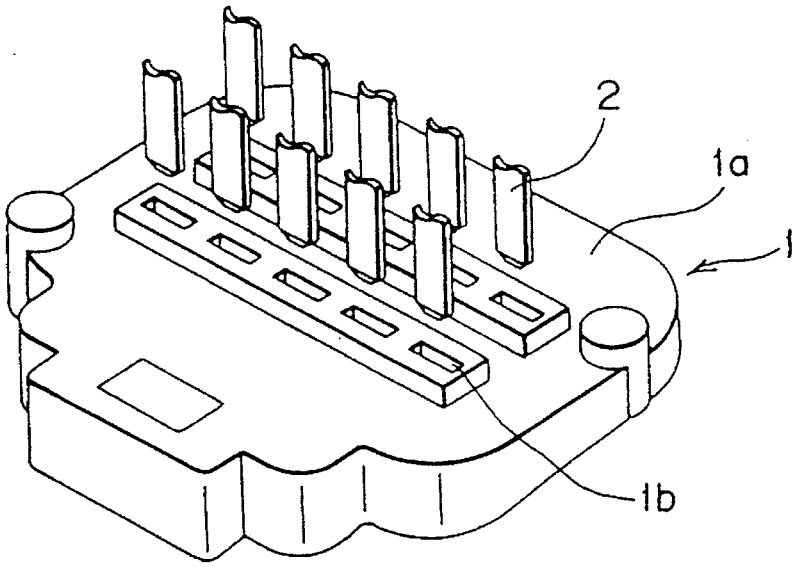
Fig. 1 PRIOR ART
FIG. 1 is a perspective view of a lower casing of a prior art electrical connection box referenced above.
Figure 2:
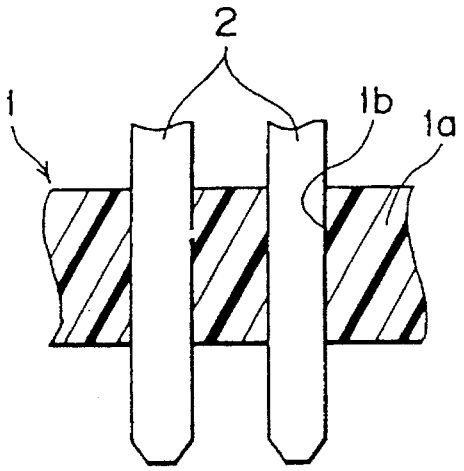
Fig. 2 PRIOR ART
FIGS. 2 and 3 are fragmentary sectional views of the lower casing of FIG. 1 referenced above.
Figure 3:
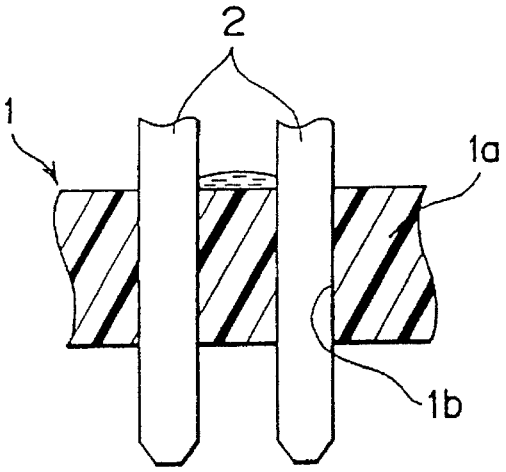
Fig. 3 PRIOR ART

Referring now to the drawings, there is shown in FIGS. 4 to 7, a drainage construction for an electrical connection box, according to one embodiment of the present invention. The electrical connection box is constituted by a lower casing 10 shown in FIG. 4 and an upper casing (not shown). Although not specifically shown, bus bars and insulation plates are accommodated in the electrical connection box. Tabs 11 bent from the bus bars are adapted to be projected from the lower casing 10.

Figure 4:
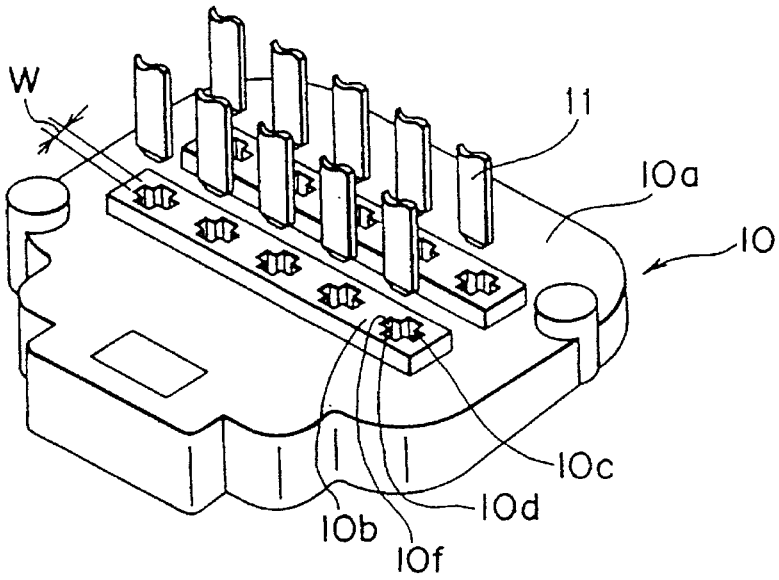
FIG. 4 is a perspective view of a lower casing of an electrical connection box having a drainage construction according to the present invention.
Figure 5:
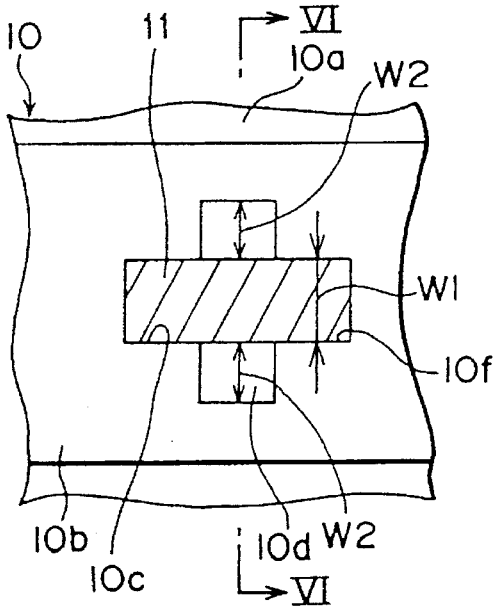
FIG. 5 is a fragmentary top plan view of the lower casing of FIG. 4.
Figure 6:
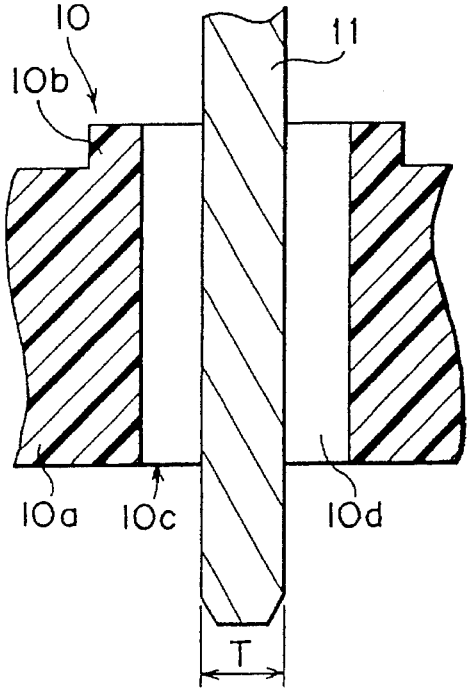
FIG. 6 is a sectional view taken along the line VI—VI in FIG. 5.
Figure 7:
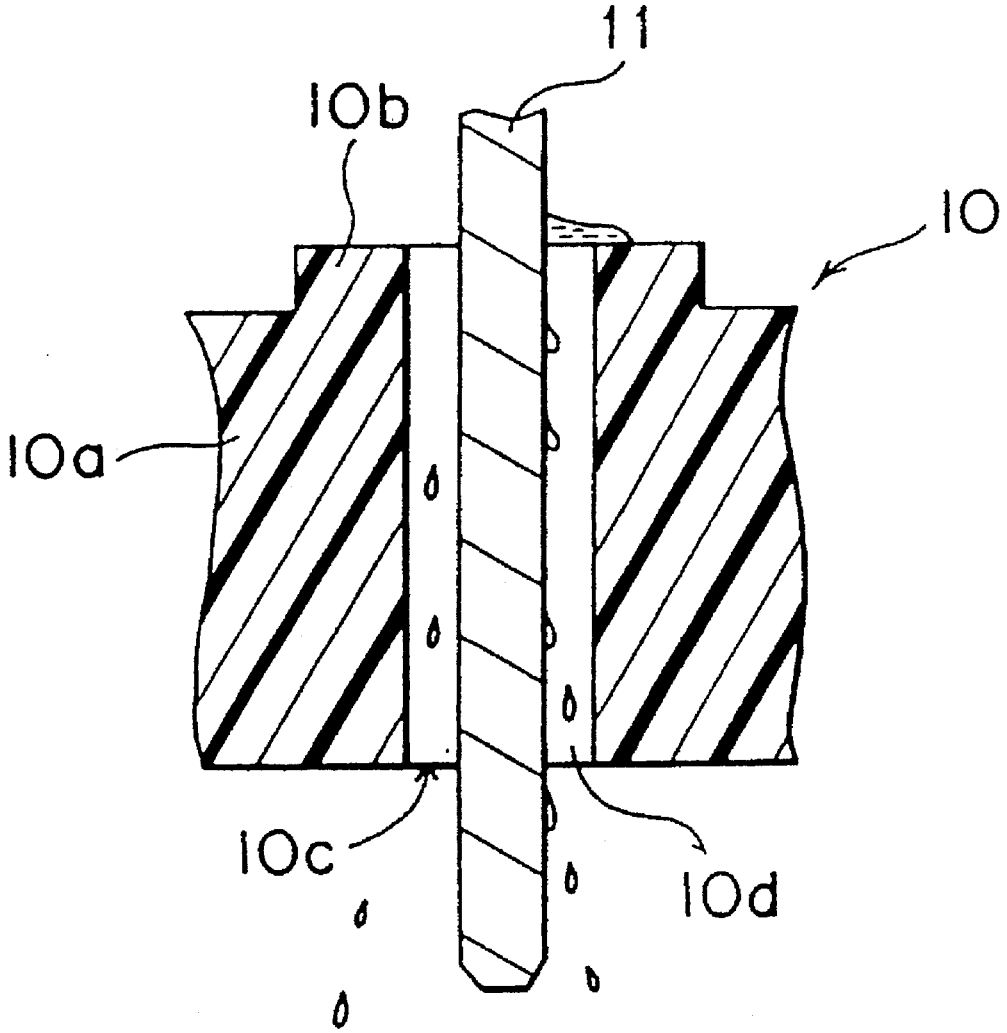
FIG. 7 is a sectional view indicative of drainage in the lower casing of FIG. 4.

As shown in FIGS. 4 to 6, rectangular step portions 10*b* are provided on a bottom plate 10*a* of the lower casing 10 and terminal through-holes 10*c* for passing the tabs 11 therethrough, respectively are formed on the step portions 10*b* at a predetermined interval. The terminal through-hole 10*c* includes a rectangular main section 10*f* corresponding to the tab 11 and a drainage section 10*d* intersecting with the main section 10*f* substantially orthogonally at a longitudinally central portion of the main section 10*f* so as to have a substantially crossed shape. The main section 10*f* has a width W1 corresponding to a thickness T of the tab 11 so as to be brought into contact with the tab 11. The drainage section 10*d* extends through a width W2 from each of opposite sides of the main section 10*f* such that water drops moving along the tab 11 can be passed through the drainage section 10*d*. For example, a clearance between the main section 10*f* and the tab 11 is set at 0.08 mm, while the width W2 of the drainage section 10*d* is set at 0.58 mm so as to allow passage of water drops through the drainage section 10*d*.

Meanwhile, in order to guide waterdrops to the drainage section 10*d*, it is preferable that an upper face of the step portion 10*b* is inclined towards the drainage section 10*d*. However, in case area of the step portion 10*b* is small and an interval between the terminal through-holes 10*c* is small, waterdrops reach the drainage section 10*d* even if the upper face of the step portion 10*b* is not inclined towards the drainage section 10*d*, so that water can be discharged from the drainage section 10*d*.

The tabs 11 of the bus bars are, respectively, inserted into the terminal through-holes 10*c* of the lower casing 10 from a state shown in FIG. 4 so as to be assembled with each other. In this assembly state, the tab 11 is closely fitted into the main section 10*f* of the terminal through-hole 10*c* such that opposite side faces of the tab 11 are, respectively, brought into contact with those of the main section 10*f*. Therefore, the tab 11 is closely held by the main section 10*f* so as to be fixed securely.

On the other hand, the drainage section 10*d* is disposed at opposite sides of a central portion of the tab 11. Thus, in case water penetrates into the electrical connection box due to dropwise condensation, etc., water drops which have reached the upper face of the step portion 10*b* of the lower casing 1 along the tab 11 can be discharged through the drainage section 10*d*.

It should be noted that the present invention is not limited to the above described embodiment. For example, if the terminal through-hole has a main section for closely holding the tab through substantial contact of an inner periphery of the main section with an outer periphery of the tab and a drainage section for defining a gap with the outer periphery of the tab and the gap has a cross-sectional area allowing passage of water drops therethrough, the terminal through-hole may be formed into any arbitrary shape.

As is clear from the foregoing description of the drainage construction of the electrical connection box, according to the present invention, when water penetrating into the electrical connection box due to dropwise condensation or the like has reached the upper face of the bottom plate of the lower casing along the tabs of the bus bars, the water can be positively discharged out of the lower casing through the wide drainage section provided at each of the terminal through-holes through which the tabs are passed.

Accordingly, such an undesirable phenomenon associated with a prior art electrical connection box can be eliminated positively in which water penetrating into the electrical connection box adheres to the upper face of the bottom plate of the lower casing and bridges neighboring tabs for electrical conduction therebetween such that shortcircuiting occurs between the neighboring tabs.

What is claimed is:

1. An electrical connection box comprising a drainage construction wherein bus bars are accommodated and tabs projecting from the bus bars are, respectively, projected from terminal through-holes through a bottom plate of a lower casing of the electrical connection box so as to be connected to a wiring harness, the drainage construction comprising:

the terminal through-holes each including a main section and a drainage section;

the main section having a shape substantially identical with a cross-sectional shape of each of the tabs;

the drainage section abutting on the main section so as to increase a width of each of the terminal through-holes; and the bottom plate comprising a rectangular step portion at said terminal through-holes;

wherein an upper face of said rectangular step portion is inclined toward said drainage section of said through-holes.

2. An electrical connection box as claimed in claim 1, wherein the main section and the drainage section intersect with each other substantially orthoganally such that each of the terminal through-holes has a substantially crossed shape.

3. An electrical connection box comprising a drainage construction wherein bus bars are accommodated and tabs projecting from the bus bars are, respectively, projected from terminal through-holes of a lower casing of the electrical connection box so as to be connected to a wiring harness, the drainage construction comprising:

the terminal through-holes each including a main section and a drainage section;

the main section having a shape substantially identical with a cross-sectional shape of each of the tabs: and the drainage section abutting on the main section so as to increase a width of each of the terminal through-holes, said drainage section defining a gap having a cross-sectional area allowing passage of water drops therethrough;

wherein the main section and the drainage section intersect with each other substantially orthoganally such that each of the terminal through-holes has a substantially crossed shape;

whereby water can be positively discharged out of the lower casing through said drainage section.

4. An electrical connection box as claimed in claim 3, wherein said gap has a width of 0.58 mm.

5. An electrical connection box as claimed in claim 4, wherein said main section defines a gap between an inner periphery of said main section and an outer periphery of said tab of 0.08 mm.

* * * * *